US008336464B1

(12) United States Patent
Xing et al.

(10) Patent No.: US 8,336,464 B1
(45) Date of Patent: Dec. 25, 2012

(54) FREIGHT CAR BOGIE AND FREIGHT CAR

(75) Inventors: Shuming Xing, Heilongjiang (CN); Zhenming Liu, Heilongjiang (CN); Shifeng Xu, Heilongjiang (CN); Haibin Hu, Heilongjiang (CN); Zhen Zhu, Heilongjiang (CN); Wendong Shao, Heilongjiang (CN); Kewei Lv, Heilongjiang (CN)

(73) Assignee: Qiqihar Railway Rolling Stock Co., Ltd., Heilongjiang (CN)

( * ) Notice: Subject to any disclaimer, the term of this patent is extended or adjusted under 35 U.S.C. 154(b) by 0 days.

(21) Appl. No.: 13/221,754

(22) Filed: Aug. 30, 2011

(51) Int. Cl.
*B61D 1/00* (2006.01)

(52) U.S. Cl. ..... 105/168; 105/167; 105/218.1

(58) Field of Classification Search ..... 105/182.1, 105/199.1, 215.2, 218.1, 219
See application file for complete search history.

(56) References Cited

U.S. PATENT DOCUMENTS

| | | | | | |
|---|---|---|---|---|---|
| 986,185 | A * | 3/1911 | Lincoln | 105/165 |
| 3,528,374 | A * | 9/1970 | Wickens | 105/168 |
| 4,067,261 | A * | 1/1978 | Scheffel | 105/168 |
| 4,067,262 | A * | 1/1978 | Scheffel | 105/168 |
| 4,134,343 | A * | 1/1979 | Jackson | 105/167 |
| 4,136,620 | A * | 1/1979 | Scheffel et al. | 105/168 |
| 4,162,653 | A * | 7/1979 | Wickens | 105/166 |
| 4,237,791 | A * | 12/1980 | Jackson et al. | 105/168 |
| 4,258,629 | A * | 3/1981 | Jackson et al. | 105/167 |
| 4,300,454 | A * | 11/1981 | Scheffel | 105/168 |
| 4,429,637 | A * | 2/1984 | Jackson et al. | 105/168 |
| 4,570,544 | A * | 2/1986 | Smith | 105/165 |
| 4,628,824 | A * | 12/1986 | Goding et al. | 105/168 |
| 5,150,658 | A * | 9/1992 | Grandy | 105/218.1 |
| 5,243,920 | A * | 9/1993 | Lamson et al. | 105/165 |
| 5,461,986 | A * | 10/1995 | Sarnicki et al. | 105/165 |
| 5,588,367 | A * | 12/1996 | Scheffel | 105/168 |
| 5,671,680 | A * | 9/1997 | DelGreco | 104/130.07 |
| 5,746,134 | A * | 5/1998 | Scheffel | 105/168 |
| 6,910,426 | B2 * | 6/2005 | Krishnaswami | 105/167 |
| 2007/0181033 | A1 * | 8/2007 | Forbes et al. | 105/218.1 |

* cited by examiner

*Primary Examiner* — Jason C Smith
(74) *Attorney, Agent, or Firm* — J.C. Patents

(57) ABSTRACT

A freight car bogie and a freight car are provided. The freight car bogie includes two wheel set assemblies, side frames, and a bolster. The freight car bogie further includes a first connecting rod and a second connecting rod. The first connecting rod and the second connecting rod are crossed in an X form to pass through reserved holes at two sides of a belly of the bolster. The first connecting rod and the second connecting rod are separated from each other at a crossing portion. The first connecting rod includes a first end and a second end. The second connecting rod includes a third end and a fourth end. The first end and the third end are resiliently connected to one of the side frames and symmetrical about a center line of the bolster. The second end and the fourth end are resiliently connected to the other side frame and symmetrical about the center line of the bolster. Therefore, a warp resistant rigidity of the freight car bogie is increased, and an operation speed and capability for adapting to track irregularities of a three-piece casting steel bogie are raised.

10 Claims, 11 Drawing Sheets

FREIGHT CAR BOGIE AND FREIGHT CAR

FIELD OF THE TECHNOLOGY

The present invention relates to transportation equipment, and more particularly to a freight car bogie and a freight car.

BACKGROUND

Nowadays, there are two main kinds of freight car bogies in the word, one is three-piece casting steel bogie, and the other one is fabricated bogie.

The three-piece casting steel bogie comprises side frames, bolster and wheel set assemblies, and further comprises brake rigging and spring damping device. Connection between two side frames of a three-piece casting steel bogie in a horizontal plane relies on a load spring, a bolster, a side frame pedestal, and a journal box including adaptor and bearing. FIG. 1 is a schematic structural view of a freight car bogie in the prior art. As shown in FIG. 1, two side frames 1 are built over a wheel set assembly 2 through the side frame pedestal and the journal box, the two side frames 1 are connected with each other by a bolster 5, a freight car bogie 100 has loose connections and warp resistant rigidities of two side frames 1 are low. When a vehicle runs fast, wheel sets are excited due to various irregularities of the track, so that warp displacement occurs easily between the two side frames 1. Again referring to FIG. 1, a distance d is generated between the two side frames 1 at front side to rear side, resulting in hunting movement of the freight car, so that wheel flanges are seriously worn and derailment possibility increases. A situation of warp deformation of the freight car bogie 100 is as shown in FIG. 1.

Additionally, the wheel sets are connected and positioned through contact between the adaptor and side frame pedestal roof, which is a steel-steel friction pair, a type of dry friction constraint. A dry friction form between the adaptor and the side frame pedestal roof causes a large difference of friction forces between an empty car and a loaded car. For the empty car, the control force to the wheel sets applied by the side frame through adaptor is weak, the wheel sets inclines to rotary about the vertical shaft, but for the loaded car, the control force to the wheel sets applied by the side frame through adaptor is strong, the wheel sets is hard to rotary about the vertical shaft. When the vehicle passes along a curve line, angles of attack of the wheel flanges between the wheel sets and the track are large upon the empty car or the loaded car, so that tendency to radial positions and automatic reset are unable to be realized, causing problems such as more serious wheel flange wear and abrasion between the adaptor and the side frames.

Further, clearance side bearing structures are used at two sides on the top of the bolster. The track structures are unable to provide the car body with a rotation suppression effect for stability of the bogie, so that reliability of operation of the vehicle is decreased.

Moreover, channel steel brake beam structures are adopted at two sides of the side surfaces of the bolster. The channel steel brake beam is a welded structure, which has potential safety hazards and high maintenance cost.

The above technical defects of the freight car bogie affect performance of the freight car bogie during operation along a tangent line and a curve line to different degree, reduce an operation speed and stability of the freight car, and increase operation cost and maintenance cost.

SUMMARY

The present invention is directed to a freight car bogie and a freight car, a first connecting rod and a second connecting rod crossed in an "X" form are adopted to be resiliently connected to side frames, so as to increase the warp resistant rigidity of the freight car bogie, improve the performance of the freight car bogie when the vehicle passes along the tangent line and curve line, and further raise an operation speed of the three-piece casting steel bogie and capability of adapting to track irregularities.

In order to achieve the above objectives, the present invention provides a freight car bogie, which includes two wheel set assemblies, two side frames disposed at outer sides of the wheel sets, adaptor disposed at the outer sides of the wheel sets and below the side frames, a bolster fixedly connected to center positions of the two side frames, and brake rigging located at two sides of the bolster. The freight car bogie further includes a first connecting rod and a second connecting rod.

The first connecting rod and the second connecting rod are crossed in an "X" form to pass through reserved holes at two sides of a belly of the bolster. The first connecting rod and the second connecting rod are separated from each other at a crossing portion. The first connecting rod includes a first end and a second end. The second connecting rod includes a third end and a fourth end. The first end and the third end are resiliently connected to one of the side frames and symmetrical about a center line of the bolster. The second end and the fourth end are resiliently connected to the other side frame and symmetrical about the center line of the bolster.

In the freight car bogie, the first connecting rod and the second connecting rod are in the same plane; a cross hole is formed at the crossing portion of the first connecting rod and the second connecting rod passes through the cross hole, or a notch is formed at the crossing position of the first connecting rod and/or the second connecting rod, and the first connecting rod and the second connecting rod are crossed with each other at the notch.

In the freight car bogie, two supporting seats symmetrical about the center line of the bolster are fixedly disposed on each of the side frames respectively. The ends of the connecting rod and supporting seats are provided with mounting holes, and a stepped shaft rod passes through corresponding the mounting holes in order to connect with the connecting rod and the supporting seats; and tapered rubber sleeves are sandwiched between the inner wall of the mounting holes and the outer wall of the shaft rod.

In the freight car bogie, one end of the shaft rod is locked with the mounting hole of the supporting seats, and the other end of the shaft rod which passes through a gland and a washer in turn is screwed with a nut, and cotters are inserted at one side of the shaft rod, which the shaft rod passed through the nuts, to prevent the shaft rod from loosening.

The freight car bogie further includes journal box resilient positioning devices, disposed between the adaptor and the side frames, so as to generate longitudinal, lateral, and vertical resilient deformation between the adaptor and the side frames.

In the freight car bogie, the journal box resilient positioning device includes a splayed rubber pad fitting the adaptor in shape and an upper steel liner and a lower steel liner having the same shape as the splayed rubber pad. The splayed rubber pad is sandwiched between the upper steel liner and the lower steel liner. Vulcanized connections are provided between the upper steel liner, the splayed rubber pad, and the lower steel liner.

In the freight car bogie, the center portion of the journal box resilient positioning device is connected to the adaptor and the side frame through a positioning pin.

In the freight car bogie, ribs are disposed at the edge of the center of the journal box resilient positioning device, and grooves are disposed at the edges of the journal box resilient positioning device and the side frame which orient at the journal box resilient positioning device, and the ribs extent into the grooves of the adaptor and the side frames respectively to be locked.

In the freight car bogie, the first connecting rod and the second connecting rod are located on a plane where a center line of axles of the two wheel sets is located.

In the freight car bogie, the bolster is formed by matching an upper and a lower piece casting with an integrated core.

In the freight car bogie, the side frame is formed by matching an upper and a lower piece casting with an integrated core.

In the freight car bogie, the brake rigging includes a composite brake beam. The composite brake beam includes an integrally formed bow beam, trusses connected to middle portions of a front rod and a rear rod of the bow beam, and high-friction composite brake shoes disposed at two ends of the bow beam.

In the freight car bogie, sliders for sliding in slide tracks at the side frames are disposed on outer surfaces of the high-friction composite brake shoes. Slider wear sleeves are sleeved over the sliders.

The freight car bogie further includes double-action constant-contact resilient side-bearings disposed at two sides of a top portion of the bolster. The double-action constant-contact resilient side-bearings include side bearing seats, side bearing bodies pressed on the side bearing seats, roller seats located at sides of the side bearing seats, and rollers mounted on the roller seats.

In the freight car bogie, wear-resistant plates are inserted on top surfaces of the side bearing bodies of the double-action constant-contact resilient side-bearings.

The freight car bogie further includes a center plate located at a middle portion of the bolster and a center plate wear liner disposed on the center plate. In order to achieve the above objectives, the present invention further provides a freight car, which includes a car body and a bogie. The bogie comprising: two wheel set assembles, two side frames disposed at outer sides of the wheel set assembles, adaptors disposed at the outer sides of the wheel set assemblies and below the side frames, a bolster fixedly connected to center positions of the two side frames, brake riggings located at two sides of the bolster, a first connecting rod, and a second connecting rod, wherein the first connecting rod and the second connecting rod are crossed in an "X" form passing through reserved holes at two sides of a belly of the bolster, the first connecting rod and the second connecting rod are separated from each other at a crossing portion, the first connecting rod comprises a first end and a second end, the second connecting rod comprises a third end and a fourth end, the first end and the third end are resiliently connected to one of the side frames and symmetrical about a center line of the bolster, and the second end and the fourth end are resiliently connected to the other side frame and symmetrical about the center line of the bolster.

In the freight car, the first connecting rod and the second connecting rod are in the same plane; a cross hole is formed at the crossing portion of the first connecting rod and the second connecting rod passes through the cross hole, or a notch is formed at the crossing position of the first connecting rod and/or the second connecting rod, and the first connecting rod and the second connecting rod are crossed with each other at the notch.

The freight car further comprises journal box resilient positioning devices, disposed between the adaptor and the side frames, so as to generate longitudinal, lateral, and vertical resilient deformation between the adaptor and the side frames.

In the freight car, the journal box resilient positioning device comprises: a splayed rubber pad fitting the adaptor in shape and an upper steel liner and a lower steel liner having the same shape as the splayed rubber pad, the splayed rubber pad is sandwiched between the upper steel liner and the lower steel liner, and combined connections are provided between the upper steel liner, the splayed rubber pad, and the lower steel liner.

In the freight car, the center portion of the journal box resilient positioning device is connected to the adaptor and the side frame through a positioning pin.

In the freight car, ribs are disposed at the edge of the center of the journal box resilient positioning device, and grooves are disposed at the edges of the journal box resilient positioning device and the side frame which orient at the journal box resilient positioning device, and the ribs extent into the grooves of the adaptor and the side frames respectively to be locked.

It can be seen from the above technical solutions that, the freight car bogie and the freight car provided in the present invention adopt a first connecting rod and a second connecting rod crossed in an "X" form to be resiliently connected to the side frames, and the first connecting rod and the second connecting rod are in the same plane, which cross with each other through the cross hole or the notch. The four-connecting-rod mechanism controls front and back, left and right displacement and warp deformation of the two side frames, that is, warp resistant rigidity of the freight car bogie is increased, so as to further raise an operation speed of the three-piece casting steel bogie. Moreover, resilient connections are provided between the connecting rods and the side frames. The side frames can rotate in a vertical direction relative to the connecting rods, so as to enhance the capability of the three-piece casting steel bogie for adapting to track irregularities.

The technical solutions of the present invention are further illustrated in detail below with reference to the accompanying drawings and the embodiments.

BRIEF DESCRIPTION OF THE DRAWINGS

The present invention will become more fully understood from the detailed description given herein below for illustration only, and thus are not limitative of the present invention, and wherein.

DETAILED DESCRIPTION

The present invention provides a freight car bogie, which includes two wheel set assemblies, two side frames disposed at outer sides of the wheel sets, adaptors disposed at the outer sides of the wheel sets and below the side frames, a bolster fixedly connected to center positions of the two side frames, and brake riggings located at two sides of the bolster. The freight car bogie further includes a first connecting rod and a second connecting rod. The first connecting rod and the second connecting rod are crossed in an "X" form passing through reserved holes at two sides of a belly of the bolster. The first connecting rod and the second connecting rod are separated from each other at a crossing portion. The first connecting rod includes a first end and a second end. The second connecting rod includes a third end and a fourth end. The first end and the third end are resiliently connected to one of the side frames and symmetrical about a center line of the bolster. The second end and the fourth end are resiliently connected to the other side frame and symmetrical about the center line of the bolster.

Figure 1:
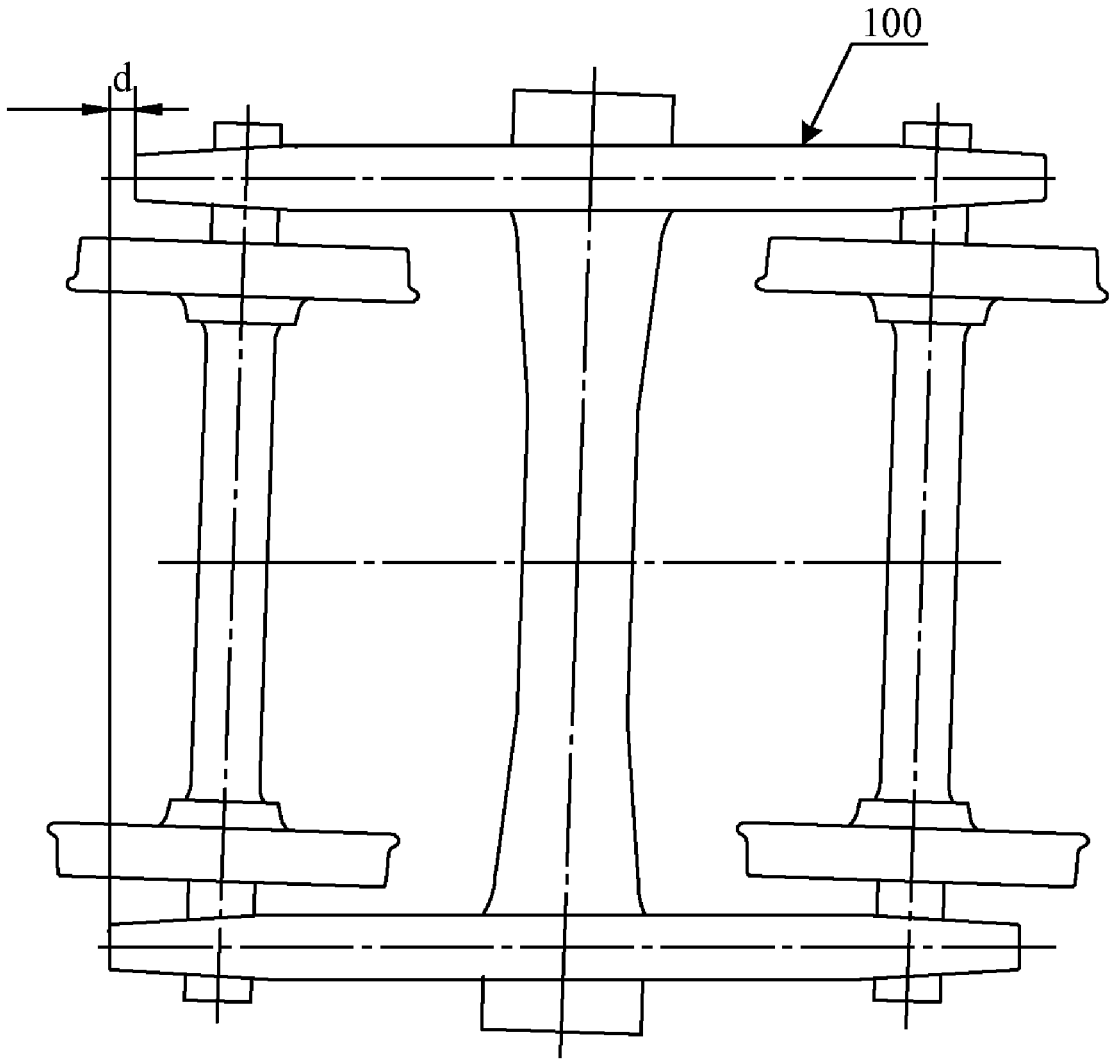
FIG. 1 is a schematic structural view of a freight car bogie in the prior art.
Figure 2:
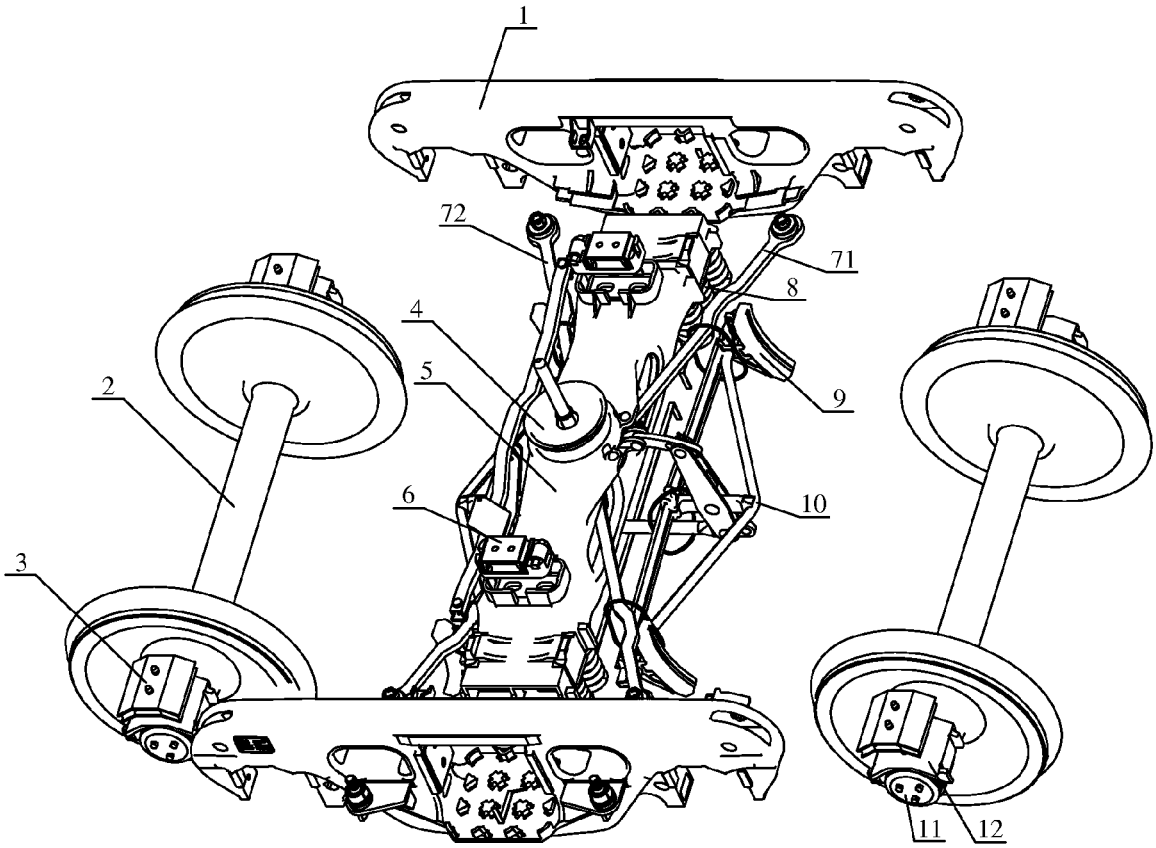
FIG. 2 is a schematic exploded view of a structure of a freight car bogie according to the present invention.

FIG. 2 is a schematic exploded view of a structure of a freight car bogie according to the present invention. As shown in FIG. 2, the freight car bogie is mainly formed of side frames 1, wheel set assemblies 2, journal box resilient positioning devices 3, a polymer center plate wear liner 4 on a center plate, a bolster 5, double-action constant-contact resilient side-bearings 6, a first connecting rod 71, a second connecting rod 72, a variable-friction damping central suspension device 8, high-friction composite brake shoes 9, composite brake beams 10 of brake riggings, double-row tapered roller bearing devices 11, and adaptors 12.

Figure 3A:
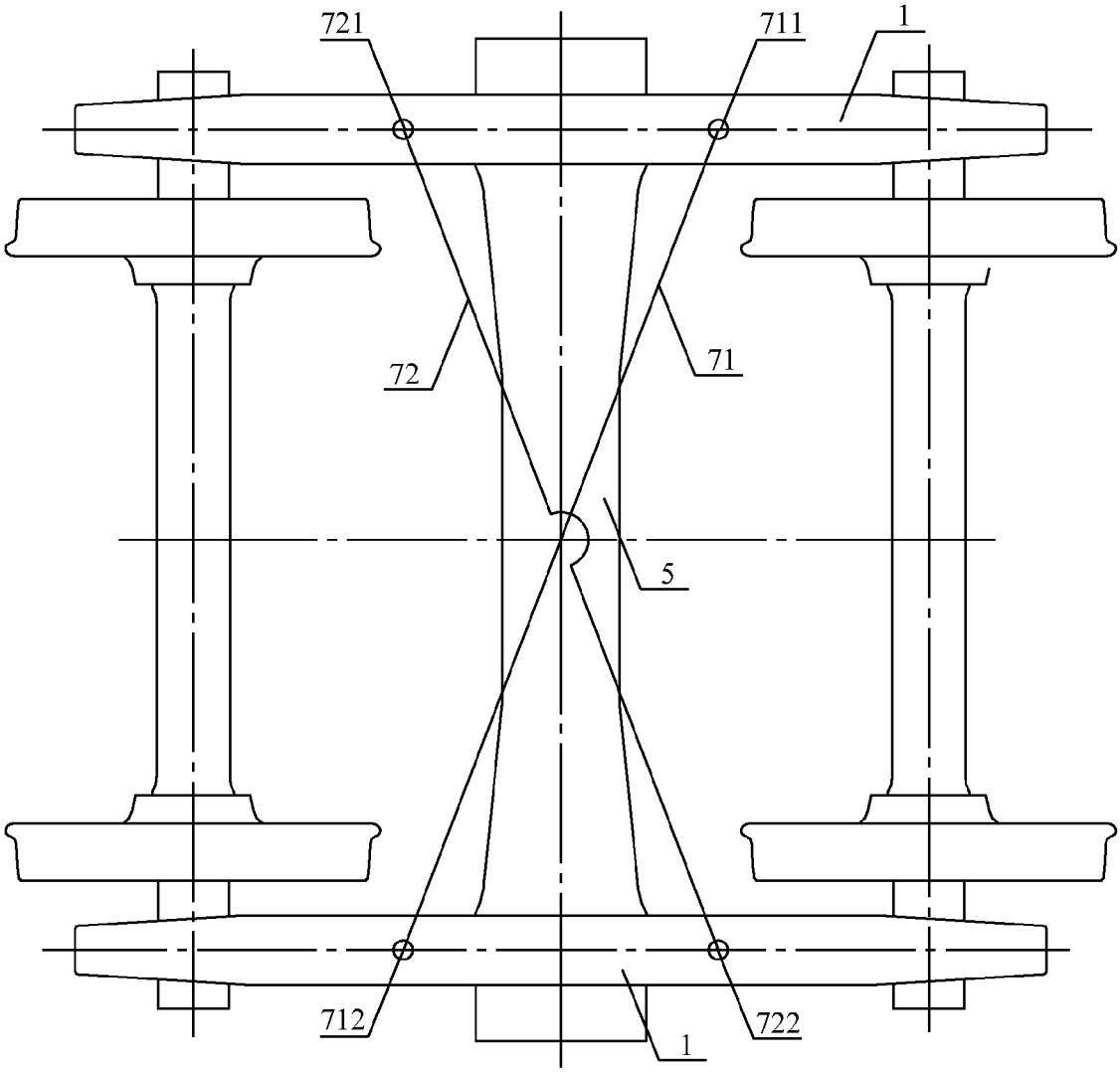
FIG. 3A is a simplified schematic plan view of the structure of the freight car bogie according to the present invention.
Figure 3B:
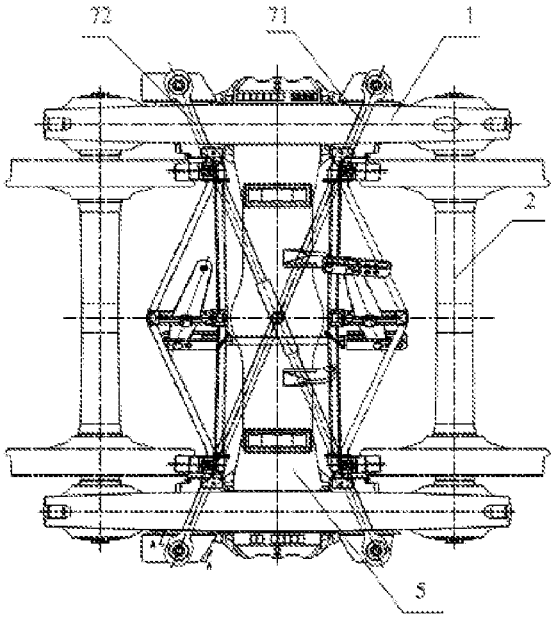
FIG. 3B is a schematic upward view of the structure of the freight car bogie according to the present invention.

FIG. 3A is a schematic plan view of the structure of the freight car bogie according to the present invention, FIG. 3B is a schematic upward view of the structure of the freight car bogie according to the present invention. As shown in FIGS. 3A and 3B, the first connecting rod 71 and the second connecting rod 72 are crossed in an "X" form to pass through reserved holes at two sides of a belly of the bolster 5. The first connecting rod 71 and the second connecting rod 72 are separated from each other at a crossing portion. The first connecting rod 71 includes a first end 711 and a second end 712. The second connecting rod 72 includes a third end 721 and a fourth end 722. The first end 711 and the third end 721 are resiliently connected to one of the two side frames 1 and symmetrical about a center line of the bolster 5. The second end 712 and the fourth end 722 are resiliently connected to the other side frame 1 and symmetrical about the center line of the bolster 5. The connecting rod structure may counteract warp deformation between the side frames 1 and generate slight trapezoid deformation.

The first connecting rod 71 and the second connecting rod 72 are preferably in the same plane. The first connecting rod 71 and the second connecting rod 72 being in the same plane means that the longitudinal central axial lines of the first connecting rod 71 and the second connecting rod 72 are substantially in the same plane.

Figure 3C:
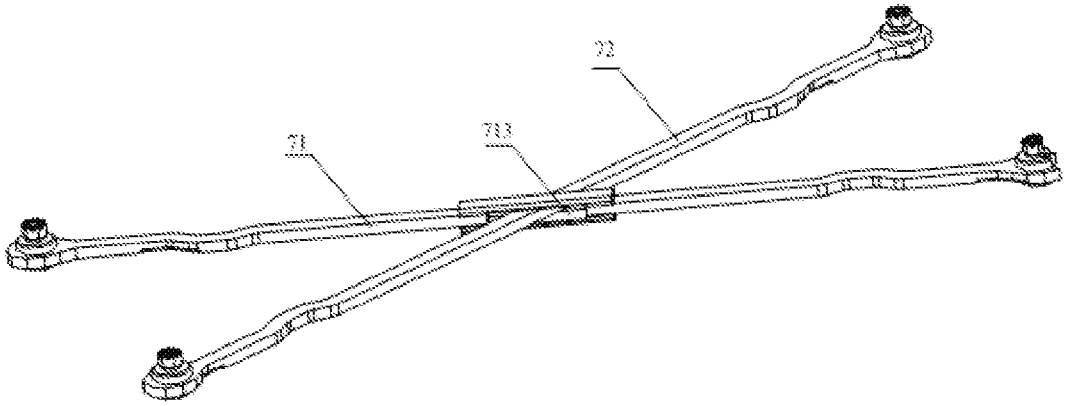
FIG. 3C is a schematic plan view of one kind of cross method of the connecting rods of the freight car bogie according to the present invention.
Figure 3D:
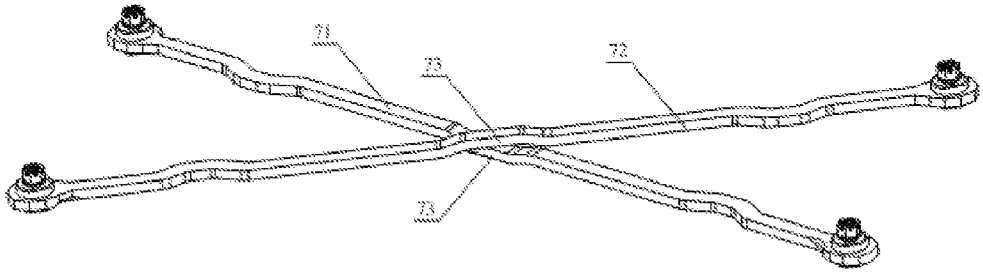
FIG. 3D is a schematic plan view of another kind of cross method of the connecting rods of the freight car bogie according to the present invention.

To ensure that the two connecting rods are in the same plane and separated from each other at the crossing portion, there are various methods for achieving above purpose. As shown in FIG. 3C, a cross hole 713 is formed at the crossing portion of the first connecting rod 71 and the second connecting rod 72 passes through the cross hole 713. Or there is another mode as shown in FIG. 3D, a notch 73 is formed at the crossing position of the first connecting rod 71 and/or the second connecting rod 72, and the first connecting rod 71 and the second connecting rod 72 are crossed with each other at the notches 73 in order to ensure the two connecting rods to be in the same plane and separated from each other at the crossing portion. In practical applications, the notch 73 can be formed either at the first connecting rod 71 or the second connecting rod 72 alone. Preferably, both the first connecting rod 71 and the second connecting rod 72 are formed with the notches 73, which are opposite in protruding and concave configurations, in order to match with each other. Therefore, the structure is symmetric and the force is applied evenly. Preferably, the shape of the central axial lines of the first connecting rod 71 and the second connecting rod 72 is such that inward protruding bending parts are formed in the first connecting rod 71 and the second connecting rod 72 at near the ends thereof in order to enhance the strength of the structure.

Figure 4A:
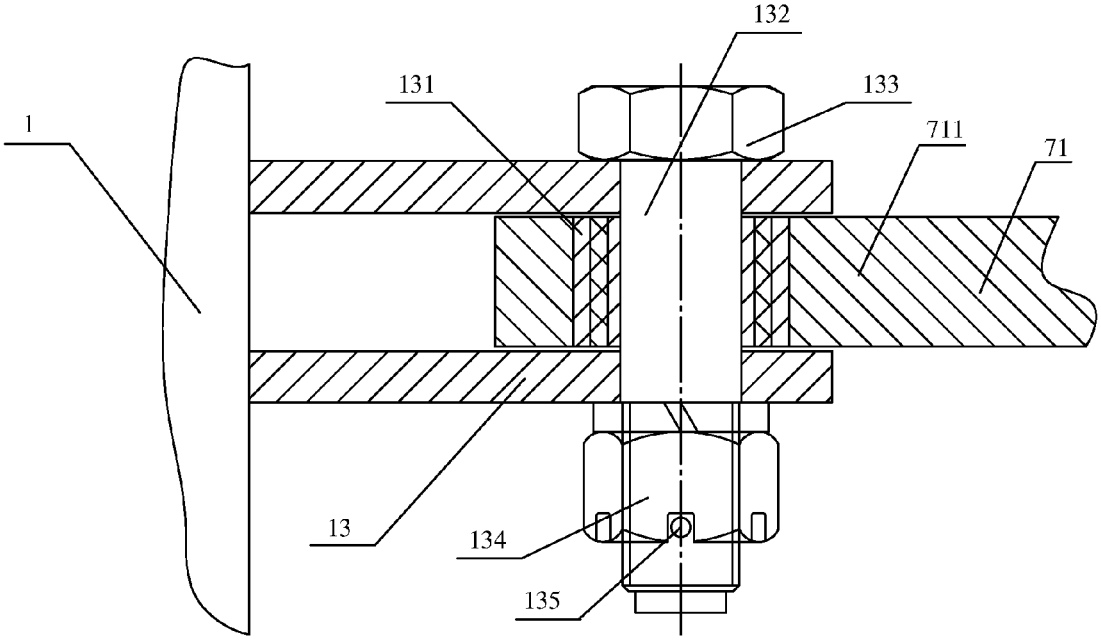
FIG. 4A is a schematic structural view of one kind of connections between connecting rods and side frames of the freight car bogie according to the present invention.

FIG. 4A is a schematic structural view of one kind of connections between the connecting rods and the side frames of the freight car bogie according to the present invention. As shown in FIG. 4A, in combination with FIG. 3B, two supporting seats 13 symmetrical about the center line of the bolster 5 are fixedly disposed on each of the side frames, respectively. The supporting seats 13 are provided with tapered rubber sleeves 131. The first end 711 and the second end 712, the third end 721 and the fourth end 722 are respectively resiliently connected to the four supporting seats 13 through the tapered rubber sleeves 131. Specifically, for example, tap holes 132 are opened on the first end 711 of the first connecting rod 71 and the corresponding supporting seat 13 respectively. The tap hole 132 on the first end 711 matches the tap hole 132 on the corresponding supporting seat 13. The first end 711 and the supporting seat 13 are fixed in bolt connection through engagement between a bolt 133 and a nut 134. A cotter 135 is inserted below the nut 134 to prevent the bolt 133 from loosening. The tapered rubber sleeve 131 may be located between the tap hole 132 and the bolt 133. Therefore, resilient connections of the first connecting rod 71 and the second connecting rod 72 to the side frames 1 are realized.

Figure 4B:
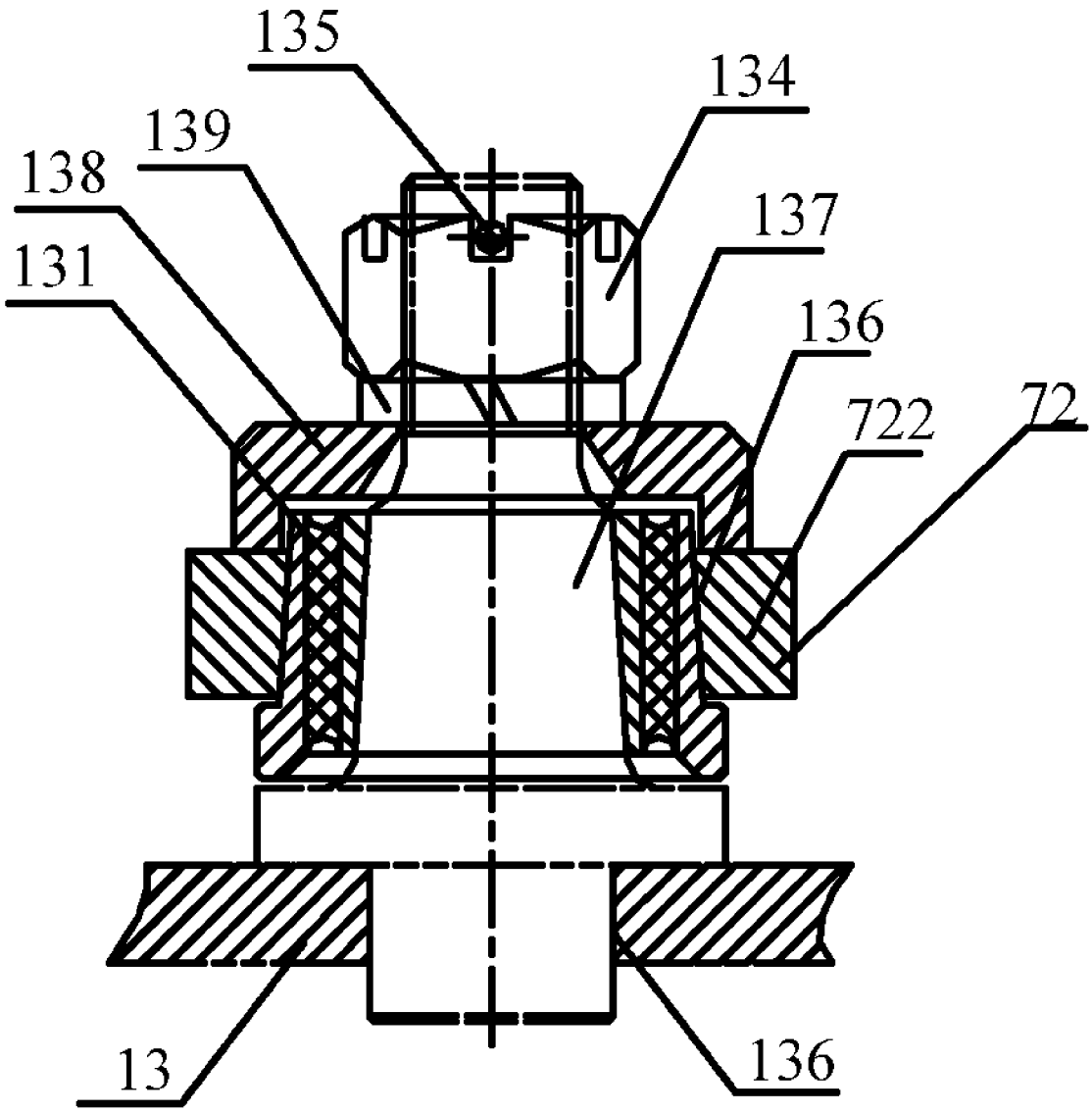
FIG. 4B is a schematic structural view of another kind of connections between connecting rods and side frames of the freight car bogie according to the present invention.

The connecting modes between the connecting rod and supporting seats are not limited to the above mode. FIG. 4B is a schematic structural view of another kind of connections between connecting rods and side frames of the freight car bogie according to the present invention, which may be a schematic structural view of the A-A of FIG. 3B. As shown in FIG. 4B, in combination with FIG. 3B, two supporting seats 13 symmetrical about the center line of the bolster 5 are fixedly disposed on each of the side frames 1 respectively, the end of each connecting rod and supporting seat 13 are provided with a mounting hole 136, and a stepped shaft rod 137 crosses corresponding the mounting hole 136 in order to connect with the connecting rod and the supporting seats 13. As shown in FIG. 4B, the fourth end 722 of the second connecting rod 72 is connected with the supporting seats 13. Tapered rubber sleeves 131 are sandwiched between the inner wall of the mounting holes 136 and the outer wall of the shaft rod 137. One end of the shaft rod 137 is locked with the mounting hole 136 of the supporting seats 13, and the other end of the shaft rod 137 which passes through a gland 138 and a washer 139 in turn is screwed with a nut 134, and cotters 135 are inserted at one side of the shaft rod 137, which the shaft rod 137 passes through the nuts 134, to prevent the shaft rod 137 from loosening. The gland 138 can cover the mounting holes 136 in order to protect the tapered rubber sleeves 131, and the washer 139 can decrease impact force in order to prevent the parts from deformation.

Figure 5A:
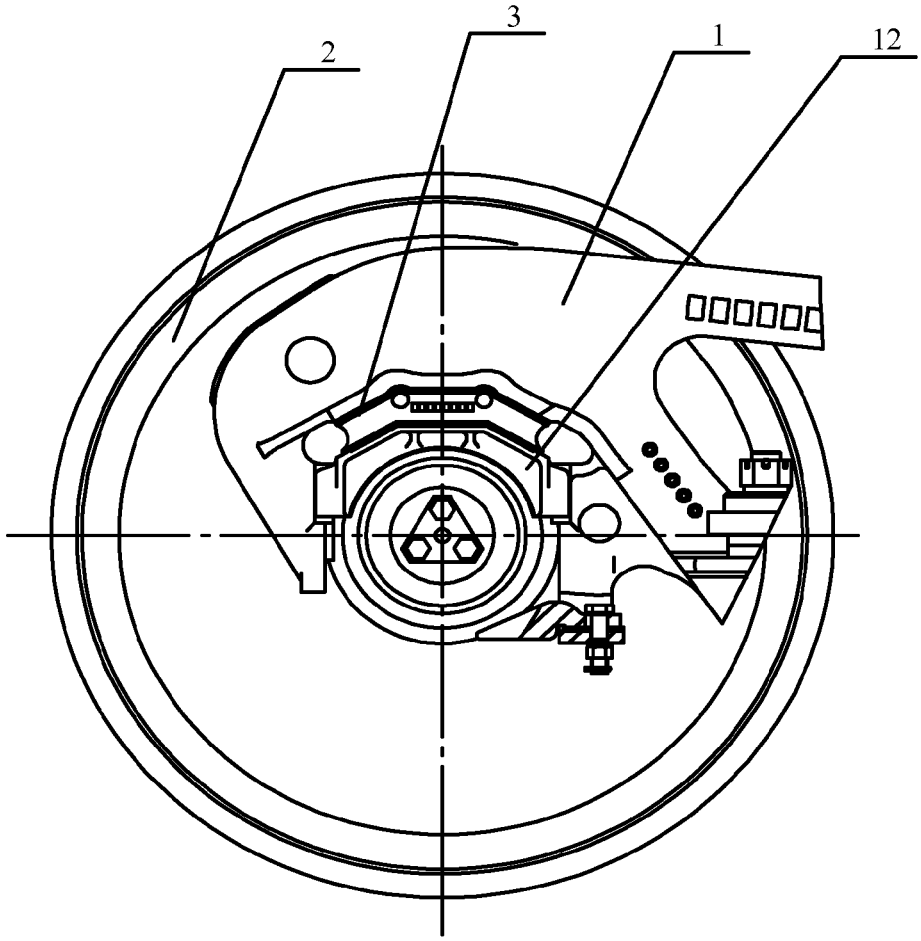
FIG. 5A is a front view of an journal box resilient positioning device of the freight car bogie according to the present invention.

FIG. 5A is a front view of the journal box resilient positioning device of the freight car bogie according to the present invention. As shown in FIG. 5A, the freight car bogie further includes the journal box resilient positioning devices 3, disposed between the adaptors 12 and the side frames 1, so as to generate longitudinal, lateral, and vertical resilient deformation between the adaptors 12 and the side frames 1.

Figure 5B:
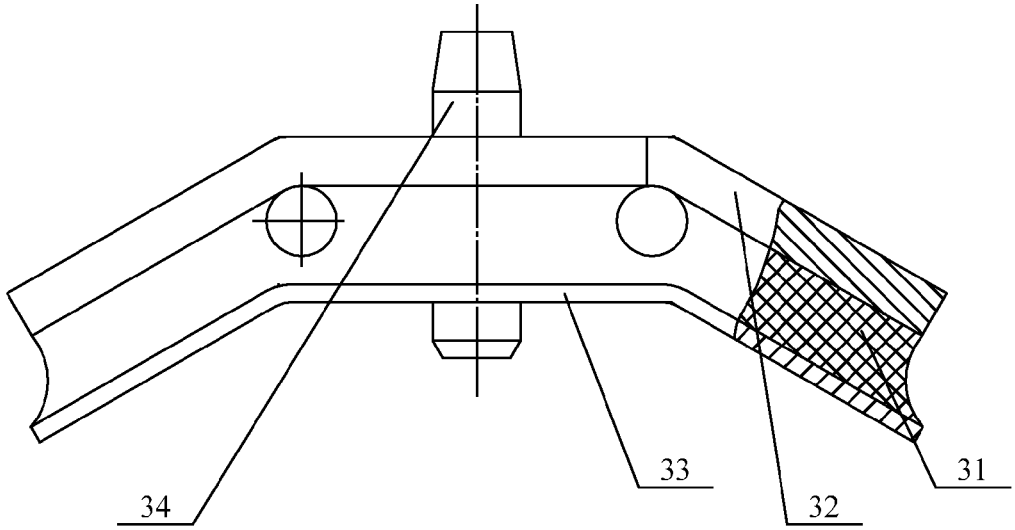
FIGS. 5B-5D is a schematic structural view of one kind of the journal box resilient positioning device of the freight car bogie according to the present invention.
Figure 5C:
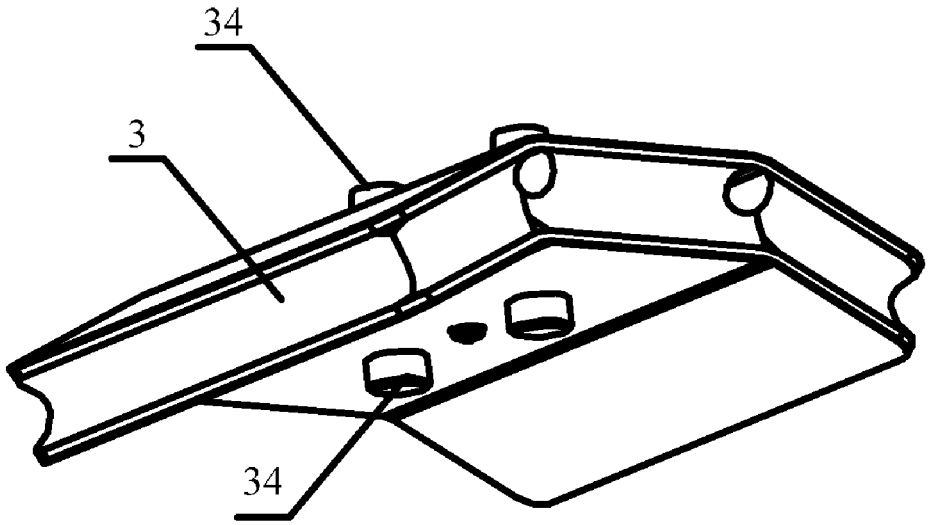
Figure 5D:
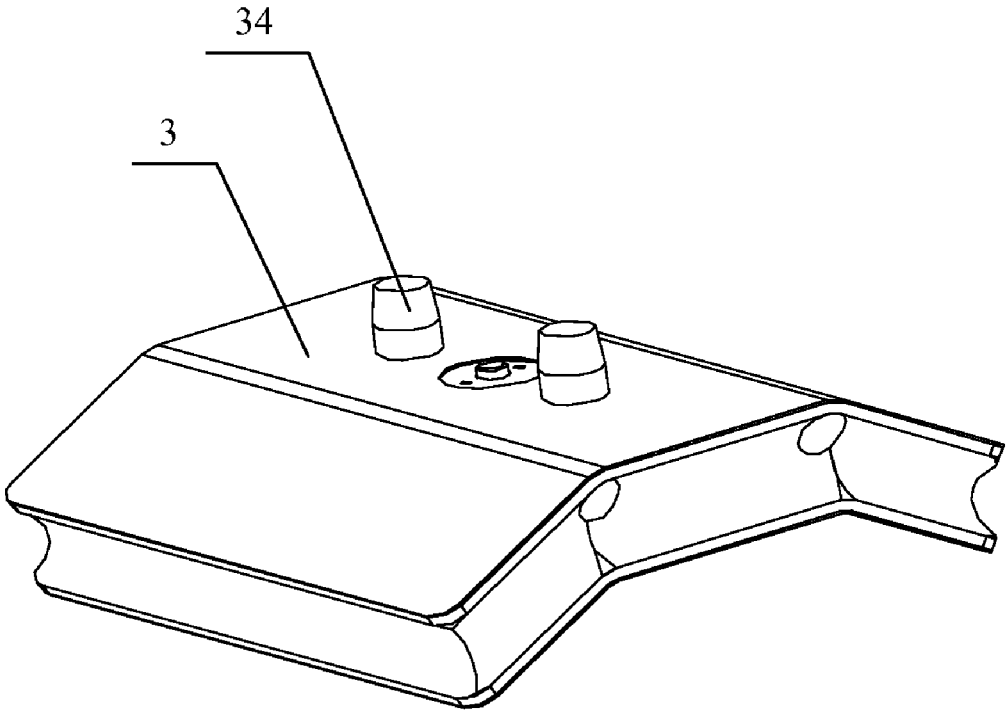

FIG. 5B is a schematic structural view of one kind of the journal box resilient positioning device of the freight car bogie according to the present invention. The journal box resilient positioning device 3 includes a splayed rubber pad 31 fitting the adaptor 12 in shape and an upper steel liner 32 and a lower steel liner 33 having the same shape as the splayed rubber pad 31. The splayed rubber pad 31 is sandwiched between the upper steel liner 32 and the lower steel liner 33. Combined connections are provided between the upper steel liner 32, the splayed rubber pad 31, and the lower steel liner 33. The center portion of the journal box resilient positioning device 3 may be connected to the adaptor 12 and the side frame 1 through one or several positioning pins 34, as shown in FIGS. 5B, 5C and 5D. The positioning pins 34 could be inserted into corresponding mounting holes on the adaptor 12 and the side frame 1. Or the positioning pins 34 and mounting holes are mounted at the positioning device 3, the adaptor 12 and the side frame 1, respectively. The journal box resilient positioning device 3 realizes resilient positioning between the side frame 1 and the adaptor 12.

Figure 5E:
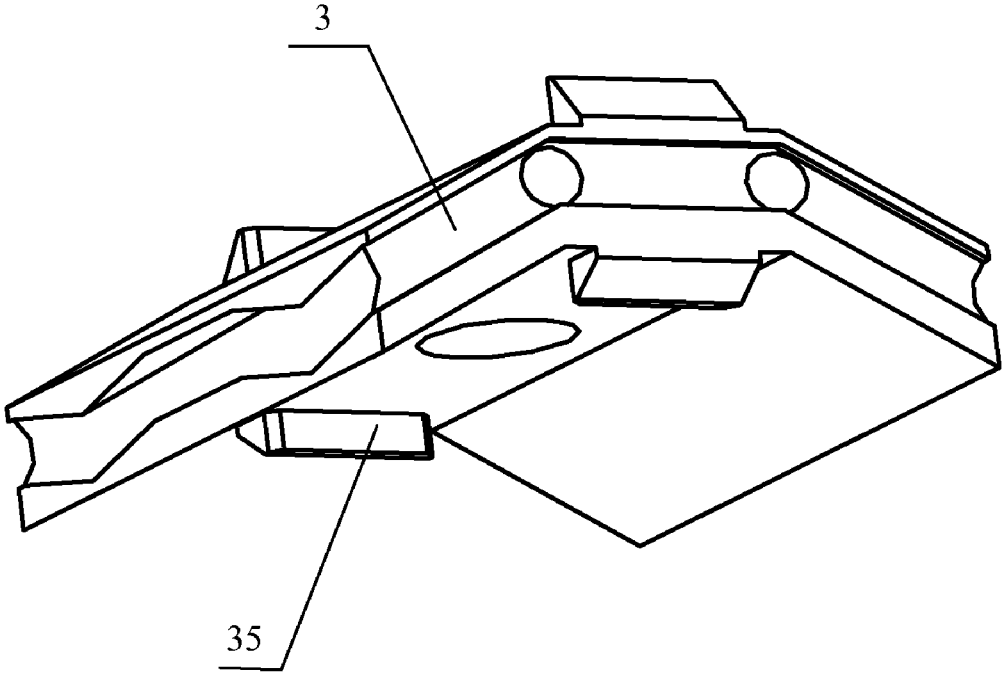
FIGS. 5E-5F is a schematic structural view of another kind of the journal box resilient positioning device of the freight car bogie according to the present invention.
Figure 5F:
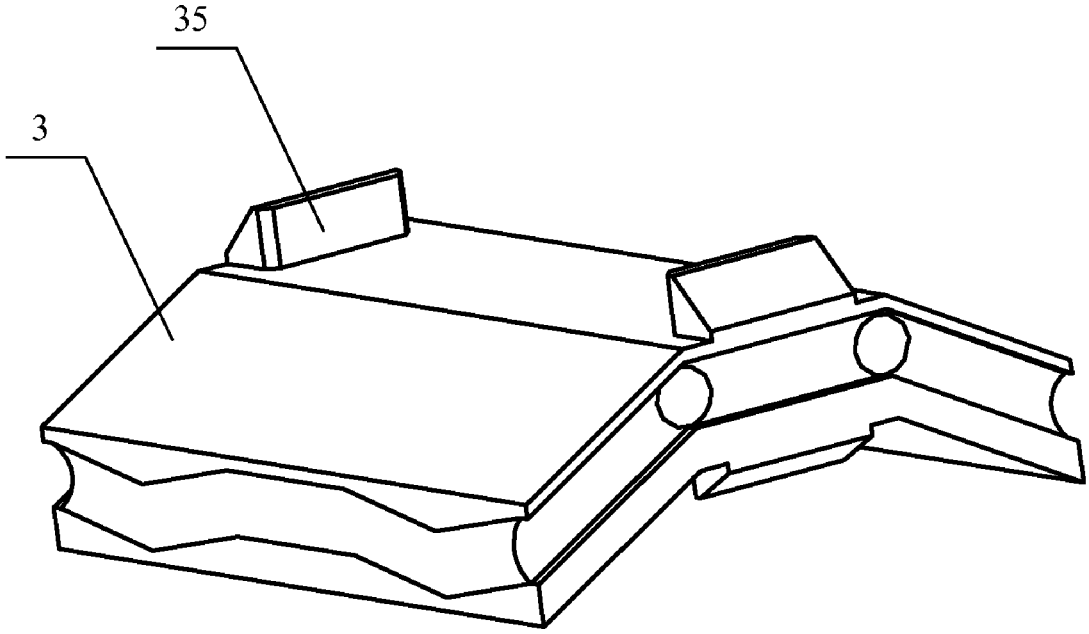

Or as shown in FIGS. 5E and 5F, there is another method for realizing the fixation between the journal box resilient positioning device 3, the adaptor 12 and the side frame 1. Ribs 35 are disposed at the edge of the center of the journal box resilient positioning device 3, and grooves are disposed at the edges of the journal box resilient positioning device and the side frame which orient at the journal box resilient positioning device 3, and the ribs 35 extent into the grooves of the adaptor and the side frames respectively to be locked.

The shapes of ribs and groove are matched with each other, preferably, the cross section of the rib is triangle, just as shown in FIGS. 5E and 5F, or hook, which could be locked with the groove.

Additionally, as shown in FIG. 2, the first connecting rod 71 and the second connecting rod 72 are located on a plane where a center line of axles of the two wheel set assemblies 2 is located.

In the freight car bogie of the present invention, based on a three-piece casting steel bogie, two connecting rods, that is, the first connecting rod 71 and the second connecting rod 72 in a crossed status through the bolster are used to connect the two side frames together. The two connecting rods are not connected in a middle crossing portion. According to geometric principles, the two connecting rods and the two side frames form a four-connecting-rod mechanism, so that the side frames 1 and the wheel set assemblies 2 maintain a rectangular shape and generate slight trapezoid deformation when necessary. The four-connecting-rod mechanism controls front and back, left and right displacement and warp deformation of the two side frames 1, that is, warp resistant rigidity of the freight car bogie is increased, so as to further raise an operation speed of the three-piece casting steel bogie. Moreover, the journal box resilient positioning devices 3 are added between the side frames 1 and the adaptor 12, so as to provide stable longitudinal, lateral positioning rigidity, thereby enhancing the performance of operation of the freight car bogie in a tangent line and a curve line. At the same time, unsprung mass that the springs on bearing platforms at two sides of the adaptor 12 bear can be decreased, and abrasions of the side frames 1 and the adaptor 12 are greatly reduced. Resilient connections are provided between the connecting rods and the side frames 1. The side frames 1 can rotate in a vertical direction relative to the connecting rods, so as to enhance the capability of the three-piece casting steel bogie for adapting to track irregularities.

Figure 6:
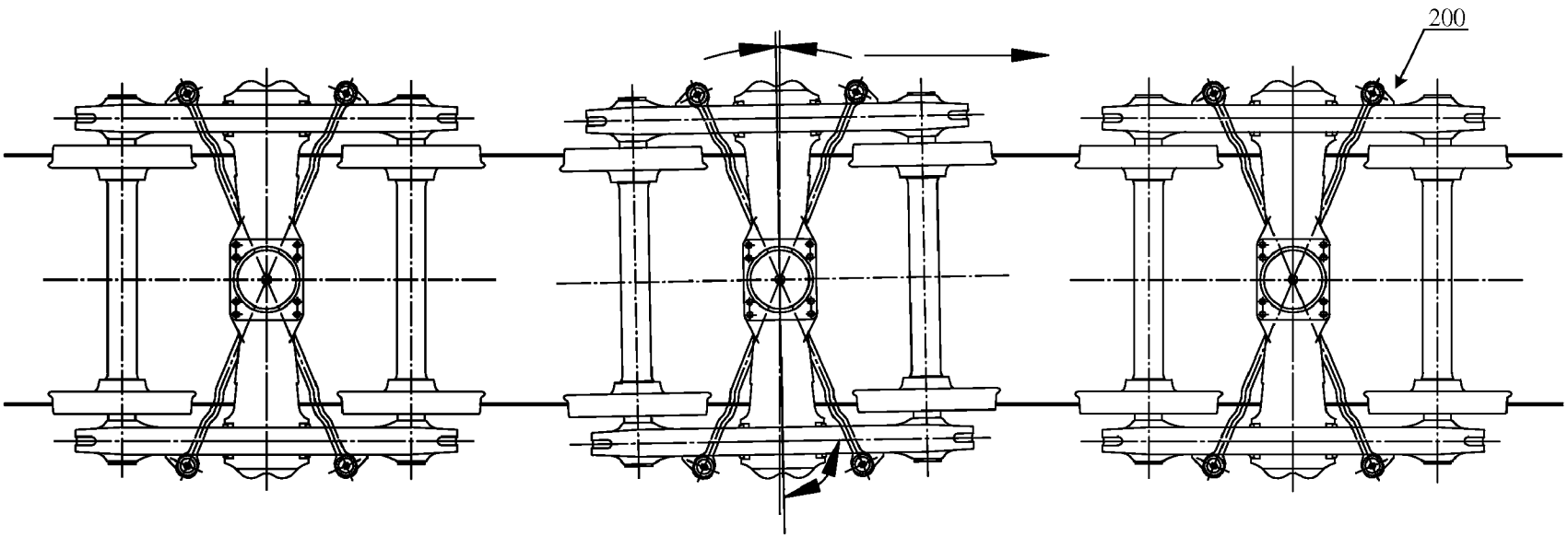
FIG. 6 is a schematic view of operation of the freight car bogie in a tangent line according to the present invention.

FIG. 6 is a schematic view of operation of the freight car bogie moving in a tangent line according to the present invention. During the operation of the freight car bogie with connecting rods 200 in a tangent line, the freight car bogie with connecting rods 200 remains in a rectangular status through a combined control effect of the connecting rods and the journal box resilient positioning devices. The wheel set assemblies always tend to move along the central line of the track under resilient restoring forces generated by the journal box resilient positioning devices, so as to raise a critical speed when the three-piece casting steel bogie performs serpentine movement in a tangent line.

Figure 7:
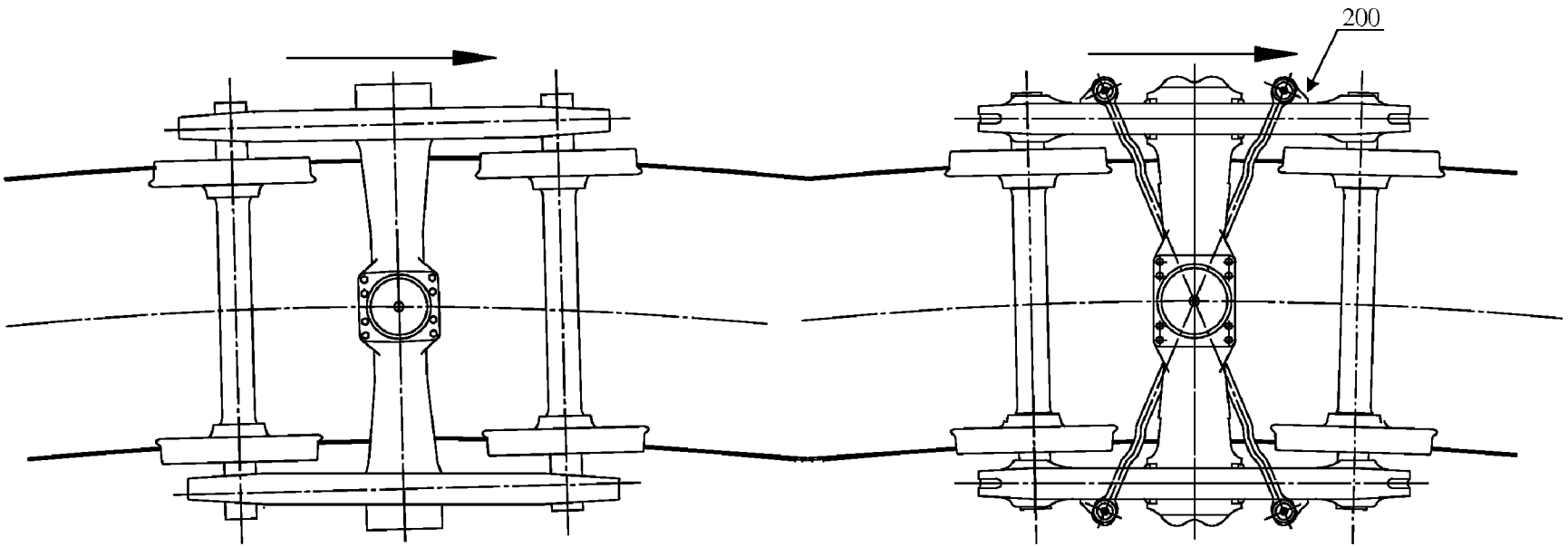
FIG. 7 is a schematic view of operation of the freight car bogie in a curve line according to the present invention.

FIG. 7 is a schematic view of operation of the freight car bogie moving in a curve line according to the present invention. During the operation of the freight car bogie with connecting rods 200 in a curve line, under the effect of creep-slip moment between the wheels and the track, the wheel sets tend to a radial direction through longitudinal resilient deformation of the journal box resilient positioning devices, so as to raise the performance of the operation of the freight car bogie with connecting rods 200 in a curve line and reduce the abrasions of the wheel flanges. Specifically, the journal box resilient positioning devices realize resilient positioning between the side frames and the adaptors and longitudinal, lateral, and vertical resilient deformation functions. The journal box resilient positioning device has a radial effect during the operation in a curve line movement, so as to reduce angles of attack of the wheel flanges between the wheels and the track and improve the performance of the operation of the freight car bogie with connecting rods 200 in a curve line. Moreover, the journal box resilient positioning devices may also reduce the unsprung mass and decrease force of vertical actions between the wheels and the track, thereby extending the service life of the wheels and the steel track.

Further, as shown in FIG. 2, the bolster 5 in the freight car bogie of the present invention may be formed by matching an upper and a lower piece casting with an integrated core. The side frame 1 may also be formed by matching an upper and a lower piece casting with an integrated core. Wet phosphor magnet powder whole inspection technique is adopted for outer surface detection of the bolster 5 and the side frames 1, so that the outer surface detection of the bolster 5 and the side frames 1 are more accurate and reliable, thereby enhancing the use safety and reliability of the bolster 5 and the side frames 1 and raising the transportation efficiency of the freight car bogie.

Moreover, as shown in FIG. 2, the brake rigging in the freight car bogie of the present invention includes the composite brake beam 10. The composite brake beam 10 includes an integrally formed bow beam, trusses connected to middle portions of a front rod and a rear rod of the bow beam, and high-friction composite brake shoes 9 disposed at two ends of the bow beam. The brake beam through combined solid forge can solve a problem of inertia mass of a conventional channel steel or bow rod roller-type brake beam, so as to enhance the use safety and reliability of the brake system. Additionally, sliders for sliding in slide tracks of the side frames 1 are further disposed on outer surfaces of the high-friction composite brake shoes 9. Slider wear sleeves are sleeved over the sliders to increase wear resistance between the sliders and the slide tracks.

Again referring to FIG. 2, the freight car bogie of the present invention further includes double-action constant-contact resilient side-bearings 6 disposed at two sides of a top portion of the bolster 5. The double-action constant-contact resilient side-bearings 6 include side bearing seats, side bearing bodies pressed on the side bearing seats, roller seats located at sides of the side bearing seats, and rollers mounted on the roller seats. Moreover, wear-resistant plates are inserted on top surfaces of the side bearing bodies of the double-action constant-contact resilient side-bearings 6, so that the freight car bogie and the car body can be tightly connected. The use of the double-action constant-contact resilient side-bearings 6 also increases a critical speed of the vehicle, and ensures safe and stable operation of the vehicle within its service life.

Additionally, referring to FIG. 2, the freight car bogie of the present invention further includes a center plate located at a middle position of the bolster 5 and a center plate wear liner 4 disposed on the center plate. The center plate wear liner 4 is a polymer center plate wear liner, which can greatly reduce abrasions between the center plate at the bottom of the car body of the freight car and the center plate on the bolster of the freight car bogie.

The present invention further provides a freight car. The freight car includes a car body and a freight car bogie as described in the above embodiments. The freight car bogie is used for supporting the car body of the freight car. In the technical solutions provided in the embodiments of the present invention, vertical and horizontal dynamic performances of the vehicle can be changed.

Finally, it should be noted that the above embodiments are merely provided for describing the technical solutions of the present invention, but not intended to limit the present invention. It should be understood by persons of ordinary skill in the art that although the present invention has been described in detail with reference to the foregoing embodiments, modifications or equivalent replacements can still be made to the technical solutions described in the foregoing embodiments, as long as such modifications or replacements do not cause the essence of corresponding technical solutions to depart from the spirit and scope of the present invention.

What is claimed is:

1. A freight car bogie comprising: two wheel set assemblies, two side frames disposed at outer sides of the wheel set assemblies, adaptors disposed at the outer sides of the wheel set assemblies and below the side frames, a bolster fixedly connected to center positions of the two side frames, brake riggings located at two sides of the bolster, a first connecting rod, and a second connecting rod, wherein the first connecting rod and the second connecting rod are crossed in an "X" form passing through reserved holes at two sides of a belly of the bolster, the first connecting rod and the second connecting rod are separated from each other at a crossing portion, the first connecting rod comprises a first end and a second end, the second connecting rod comprises a third end and a fourth end, the first end and the third end are resiliently connected to one of the side frames and symmetrical about a center line of the bolster, and the second end and the fourth end are resiliently connected to the other side frame and symmetrical about the center line of the bolster;

the first connecting rod and the second connecting rod are in the same plane; a cross hole is formed at the crossing portion of the first connecting rod and the second connecting rod passes through the cross hole, or notch is formed at the crossing position of the first connecting rod and/or the second connecting rod, and the first connecting rod and the second connecting rod are crossed with each other at the notch; and two supporting seats symmetrical about the center line of the bolster are fixedly disposed on each of the side frames respectively, the ends of the connecting rod and supporting seats are provided with mounting holes, and a stepped shaft rod passes through corresponding the mounting holes in order to connect with the connecting rod and the supporting seats; and tapered rubber sleeves are sandwiched between the inner wall of the mounting holes and the outer wall of the shaft rod.

2. The freight car bogie according to claim 1, wherein one end of the shaft rod is locked with the mounting hole of the supporting seats, and the other end of the shaft rod which passes through a gland and a washer in turn is screwed with a nut, and cotters are inserted at one side of the shaft rod, which the shaft rod passes through the nuts, to prevent the shaft rod from loosening.

3. The freight car bogie according to claim 1, further comprising: journal box resilient positioning devices, disposed between the adaptors and the side frames, so as to generate longitudinal, lateral, and vertical resilient deformation between the adaptors and the side frames.

4. The freight car bogie according to claim 3, wherein the journal box resilient positioning device comprises: a splayed rubber pad fitting the adaptors in shape and an upper steel liner and a lower steel liner having the same shape as the splayed rubber pad, the splayed rubber pad is sandwiched between the upper steel liner and the lower steel liner, and combined connections are provided between the upper steel liner, the splayed rubber pad, and the lower steel liner.

5. The freight car bogie according to claim 3, wherein the center portion of the journal box resilient positioning device is connected to the adaptor and the side frame through a positioning pin.

6. The freight car bogie according to claim 3, wherein ribs are disposed at the edge of the center of the journal box resilient positioning device, and grooves are disposed at the edges of the journal box resilient positioning device and the side frame which orient at the journal box resilient positioning device, and the ribs extent into the grooves of the adaptor and the side frames respectively to be locked.

7. The freight car bogie according to claim 1, wherein the first connecting rod and the second connecting rod are located on a plane where a center line of axles of the two wheel sets is located.

8. The freight car bogie according to claim 1, wherein the bolster is formed by matching an upper and a lower piece casting with an integrated core.

9. The freight car bogie according to claim 1, wherein the side frame is formed by matching an upper and a lower piece casting with an integrated core.

10. The freight car bogie according to of claim 1, further comprising: a center plate located at a middle portion of the bolster, and a center plate wear liner disposed on the center plate.

* * * * *